US006389719B1

(12) United States Patent
Smith

(10) Patent No.: US 6,389,719 B1
(45) Date of Patent: May 21, 2002

(54) DISPLAY DEVICE

(75) Inventor: Glenn Smith, Baton Rouge, LA (US)

(73) Assignee: Robotic Displays Corporation, Baton Rouge, LA (US)

( * ) Notice: Subject to any disclaimer, the term of this patent is extended or adjusted under 35 U.S.C. 154(b) by 0 days.

(21) Appl. No.: 09/571,187

(22) Filed: May 16, 2000

(51) Int. Cl.[7] ..... G09F 11/02
(52) U.S. Cl. ..... 40/473; 345/110; 348/815.83
(58) Field of Search ..... 345/110; 340/815.86, 340/815.87; 40/473, 484, 493, 501

(56) References Cited

U.S. PATENT DOCUMENTS

| | | | | |
|---|---|---|---|---|
| 1,566,479 A | | 12/1925 | Harvath et al. | |
| 2,063,451 A | | 12/1936 | Lunoe et al. | 240/10.1 |
| 2,354,605 A | | 7/1944 | Norman | 185/1 |
| 2,637,936 A | | 5/1953 | Dale et al. | 46/120 |
| 3,377,578 A | | 4/1968 | Reijiro | 335/229 |
| 5,063,377 A | | 11/1991 | Smith | 340/764 |
| 5,141,399 A | | 8/1992 | Duchesneau et al. | 416/157 |
| 5,142,925 A | | 9/1992 | Fauvel | 74/54 |
| 5,535,698 A | | 7/1996 | Trevisan | 116/277 |
| 6,009,647 A | | 1/2000 | Feingold | 40/433 |
| 6,122,983 A | * | 9/2000 | Hoffman | 74/337.5 |

* cited by examiner

*Primary Examiner*—Cassandra H. Davis
(74) *Attorney, Agent, or Firm*—Jones, Walker, Waechter, Poitevent, Carrere & Denegre, L.L.P.

(57) ABSTRACT

A display device, comprising a central shaft; at least one support arm, rotatably attached to the central shaft; and a cam member having at least one cam surface, the cam surface positioned so as to be engageable with at least one support arm, the cam member being movable at least axially in relation to central shaft. As the cam member moves axially of the central shaft, a cam surface contacts at least one support arm and moves it circumferentially around the central shaft. The shapes of the cam surfaces provide choreographed movement of the support arms. Visual elements may be attached to the support arms.

20 Claims, 8 Drawing Sheets

DISPLAY DEVICE

BACKGROUND OF THE INVENTION

1. Field of the Invention

This invention relates generally to display devices and, more particularly, to displays which move visual elements, such as advertising signs or product displays.

2. Description of the Prior Art

U.S. Pat. No. 5,063,377 (Smith) describes a device for producing complex and interesting movements of visual elements around a central axis, but at an increased cost. Varying advertising needs demand an eye-catching display which is also inexpensive and easy to build. The present invention meets the need for an inexpensive and interesting display device, is capable of a multitude of uses and provides and endless variety of movements limited only by the imagination of the builder. Rather than utilize complex electronic circuitry and programming, the present invention utilizes a unique mechanical approach, maintaining simplicity and cost effectiveness.

SUMMARY OF THE INVENTION

Therefore, it is an object of this invention to provide a display device, which allows a visual element to be moved in a desired pattern of movement, which is not necessarily the constant rotation of the visual element about a central axis.

It is another object of this invention to provide a display device, which includes multiple visual elements with multiple faces, the visual elements being movable about a support in a desired pattern so as to expose the faces in different directions.

It is another object of this invention to provide a display device, which allows the display of independently movable visual elements on multiple levels of a support structure.

It is still a further object of this invention to provide a display device and method which accomplishes all of the above objectives in varying combinations and at low cost.

Accordingly, a low cost display device is provided whereby visual elements can be independently transported and displayed. In general, the invention comprises a central shaft; at least one support arm, rotatably attached to the central shaft; and a cam member having at least one cam surface, the cam surface positioned so as to be engageable with at least one support arm, the cam member being movable at least axially in relation to central shaft. As the cam member moves axially of the central shaft, a cam surface contacts at least one support arm and moves it circumferentially around the central shaft. The shapes of the cam surfaces provide choreographed movement of the support arms. Visual elements may be attached to the support arms.

Preferably, the cam member is a tubular member having cam slots, through which the support arms extend. The shapes of the slots choreograph the movement of the support arms, and thus the movement of the visual elements attached to the support arms. The cam member is threadably attached to a threaded portion of the central shaft, which may be rotated by a reversible motor or other means. As the central shaft rotates in one direction, the cam member travels axially along the shaft, imparting movement to the support arms. Reversing the rotation of the shaft imparts a reverse movement of the support arms as the cam member travels along the shaft in the opposite direction.

As will be understood, the variety of movement patterns and visual elements is limited only by the imagination of the designer of a particular display device made in accordance with the invention. The number of cam members, the number, spacing and pattern of the cam slots, and the various visual elements which may be moved by the cam interface member is limitless. Thus, the invention herein provides an inexpensive and flexible device for use in a multitude of applications.

DETAILED DESCRIPTION OF PREFERRED EMBODIMENTS OF THE INVENTION

Figure 1:
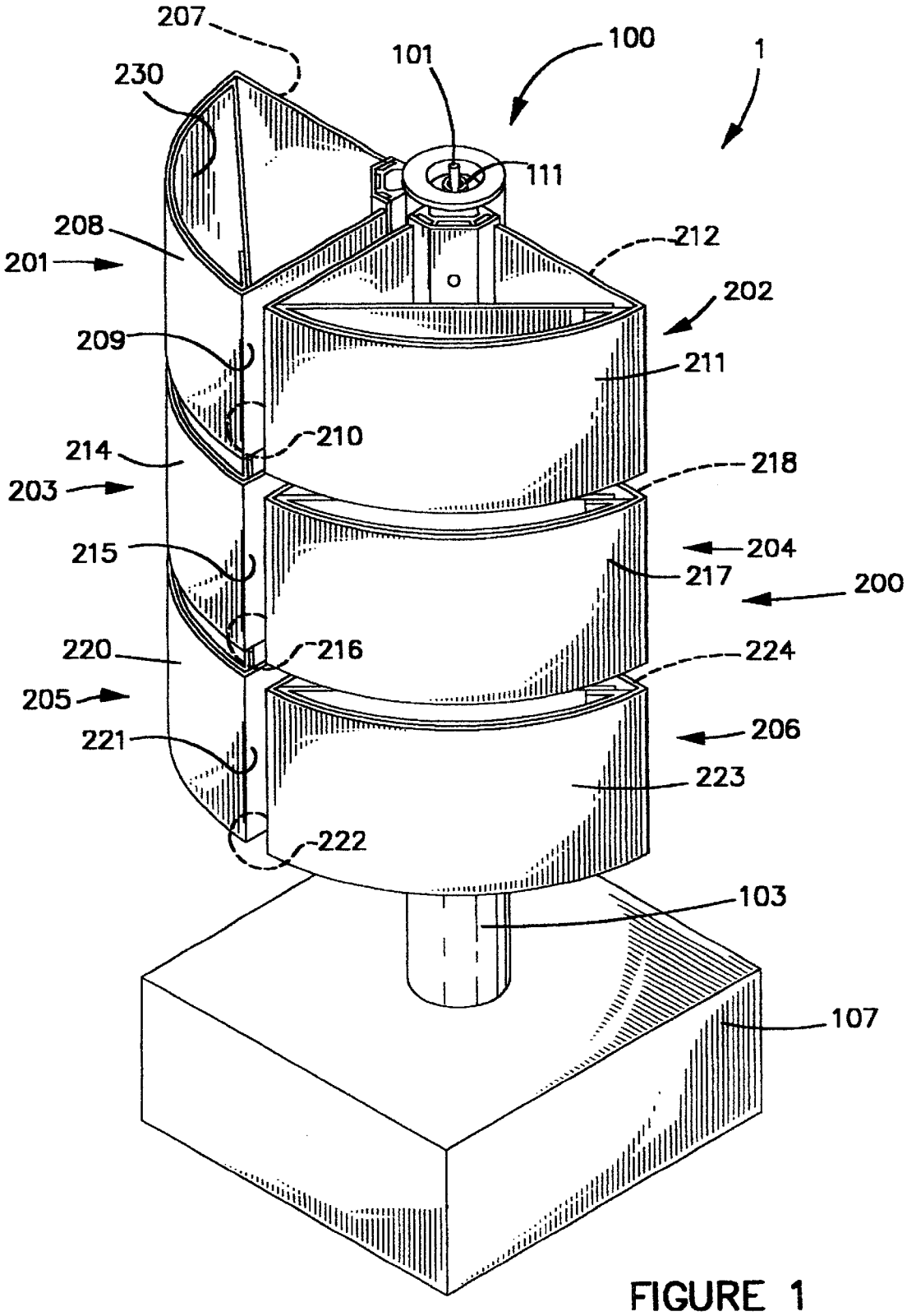
FIG. 1 is a perspective view of an embodiment of the invention illustrating the positioning and movement of visual elements.

As shown in the Figures, the invention generally comprises a display device 1, having a central shaft assembly 100, at least one visual element assembly 200 and a control assembly 300. In the embodiments shown, shaft assembly 100 is shown in a vertical orientation. There is no requirement for vertical orientation. The invention 1 may be oriented horizontally, diagonally or even in a reversed vertical position from that shown. The invention 1 may be floor or table mounted or mounted on walls or ceilings. The size of the display device 1 is dependent only on the desired size of the display and associated economic factors.

Figure 2:
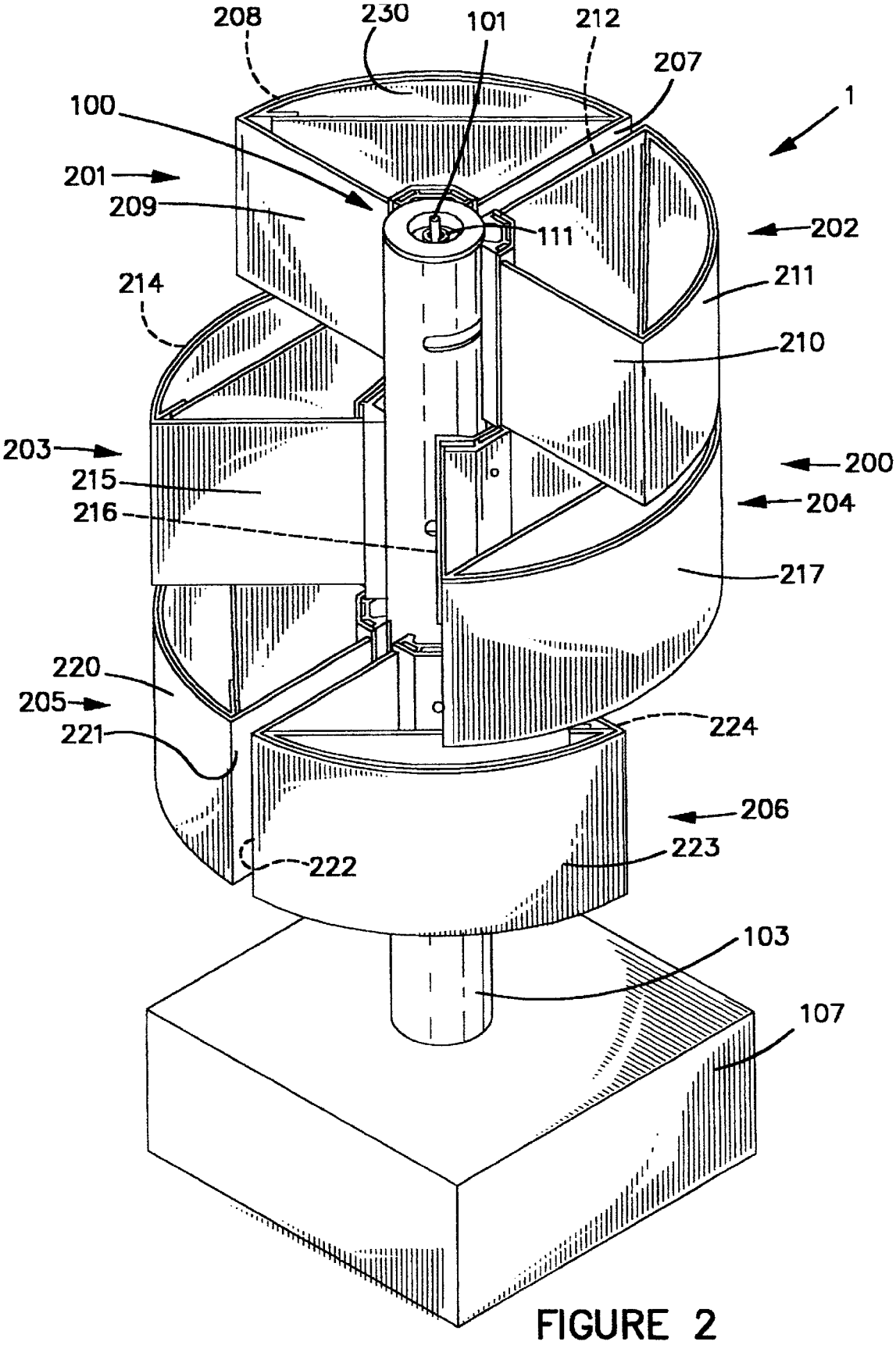
FIG. 2 is a perspective view of an embodiment of the invention illustrating the positioning and movement of visual elements.
Figure 3:
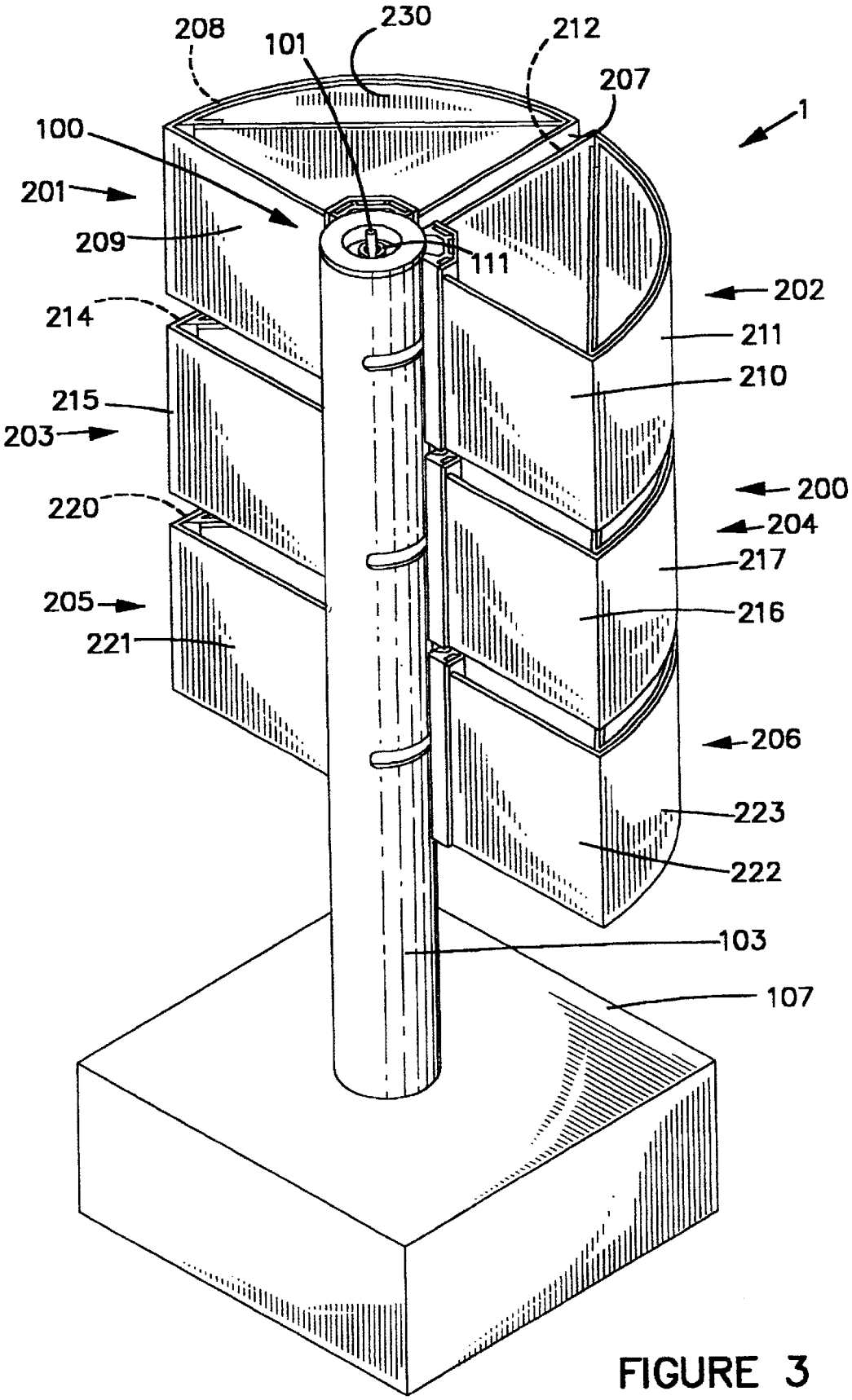
FIG. 3 is a perspective view of an embodiment of the invention illustrating the positioning and movement of visual elements.

Visual element assemblies 200 are depicted in FIGS. 1–4 and FIG. 8. FIGS. 1–3 illustrate a typical sequence of visual element motions which the device 1 can be configured to produce, in this case a sequential top to bottom opening sequence. In the embodiment shown, for example in FIG. 1, the visual element assemblies 200 may combine to form a semicylindrical structure, with each individual visual element 201–206 having a quarter-cylindrical structure. However, visual elements 200 can be of virtually any shape or composition. In fact, support arms 108 could form visual elements without the aid of visual element assemblies 200, if desired. The visual elements 200 shown in the Figures are preferably made of folded plastic sheeting, which is lightweight and easily formed into desired shapes. However, any suitable material may be used. Lighting and other elements may be installed in visual elements 200, if desired, but suitable circuitry (not shown) must be added. Also, although in the embodiment shown there are three levels of visual elements 200, the invention 1 may include one or more such levels. Finally, although in the embodiment shown there are two visual elements 200 per level, the invention 1 may include one or more visual elements 200 per level.

In order to understand the possible sequences of movement of visual elements 200, a simple series of movements will be examined. In FIG. 1 the device 1 is shown in an initial static viewing configuration, with all six visual elements 201–206 forming a complete half-cylinder. Correspondingly, all six outer graphics-bearing faces 208, 211, 214, 217, 220 and 223 are oriented toward the viewer. Inner graphics-bearing faces 207, 212, 213, 218, 219 and 224 are oriented away from the viewer. Support member 103, shown in the embodiment as a support tube, and base enclosure 107 enclose and support central shaft assembly 100 and control assembly 300 components. Support tube 103 and base enclosure 107 are fixed in position relative to all moving parts of the invention 1. Support tube 103 and enclosure 107 may be constructed of extruded or formed sheet metal, plastic or composite materials by means well known in the art.

In FIG. 2 the device 1 is shown midway through the movement sequence. The top level visual elements 201,202 have been moved ninety degrees in opposite directions around central shaft assembly 100 from their initial positions; the middle level visual elements 203,204 are halfway through a similar movement; and the bottom level visual elements 205,206 have not yet begun to move.

In FIG. 3 the device 1 is shown in a final static viewing configuration, with all six visual elements 201–206 having moved ninety degrees in opposite directions on each level from their original positions. Correspondingly, all six outer graphics-bearing faces 208, 211, 214, 217, 220 and 223 are oriented away from the viewer; inner graphics-bearing faces 209, 210, 215, 216, 221 and 222 are oriented away from the viewer; and inner graphics-bearing faces 207, 212,213,218, 219 and 224 are hidden. Thus, an interesting pattern of movement has been established wherein various faces of visual elements 200 are exposed to the viewer in a timed sequence. If the device continues to operate, control assembly 300 will cause the pattern to reverse itself to return to the position shown in FIG. 1. A more detailed discussion of the components of the invention 1 follows, using FIGS. 4–7 to illustrate the device 1 in the intermediate choreography position of FIG. 2, with various components exploded or removed for clarity.

Figure 4:
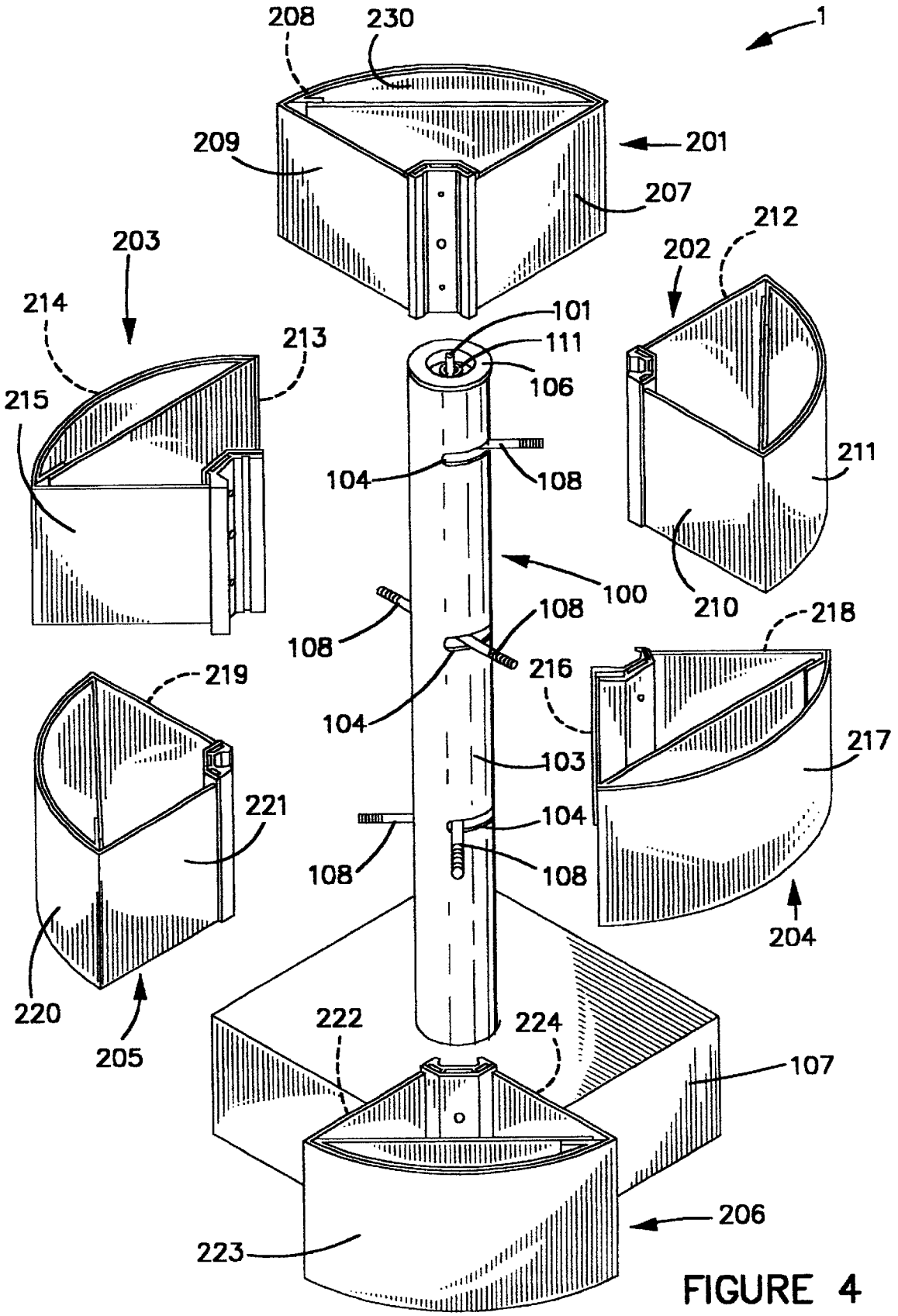
FIG. 4 is an exploded perspective view of a preferred embodiment of the invention showing the visual elements and the central shaft assembly.

FIG. 4 depicts the invention 1 with visual elements 200 exploded to reveal the exterior of shaft assembly 100. Upper end of central shaft 101 is seen protruding slightly from end cap 106, and the six support arms 108 (which support visual elements 201–206) extend through support arm slots 104 in the wall of support tube 103. Support arms 108 may be tubular as shown to provide less weight and a conduit for electrical or communications wiring to connect to visual elements 200. Support arms 108 may be threaded as shown, to facilitate attachment of visual elements 200 to arms 108. Support tube 103 also serves as a cosmetic cover for the inner components of central shaft assembly 100. In the embodiment shown, support arm slots 104 merely provide space for circumferential movement of arms 108 about central shaft 101. However, in embodiments wherein the position of an arm 108 is not axially fixed on central shaft 101, a support arm slot 104 may be used to choreograph axial movement of an arm 108. For example, if the axial position of a support arm 108 is not fixed and a support arm slot 104 is oriented diagonally with respect to central shaft 101, rather than perpendicular as shown, the support arm 108 will move axially as well as circumferentially with respect to central shaft 101.

Figure 5:
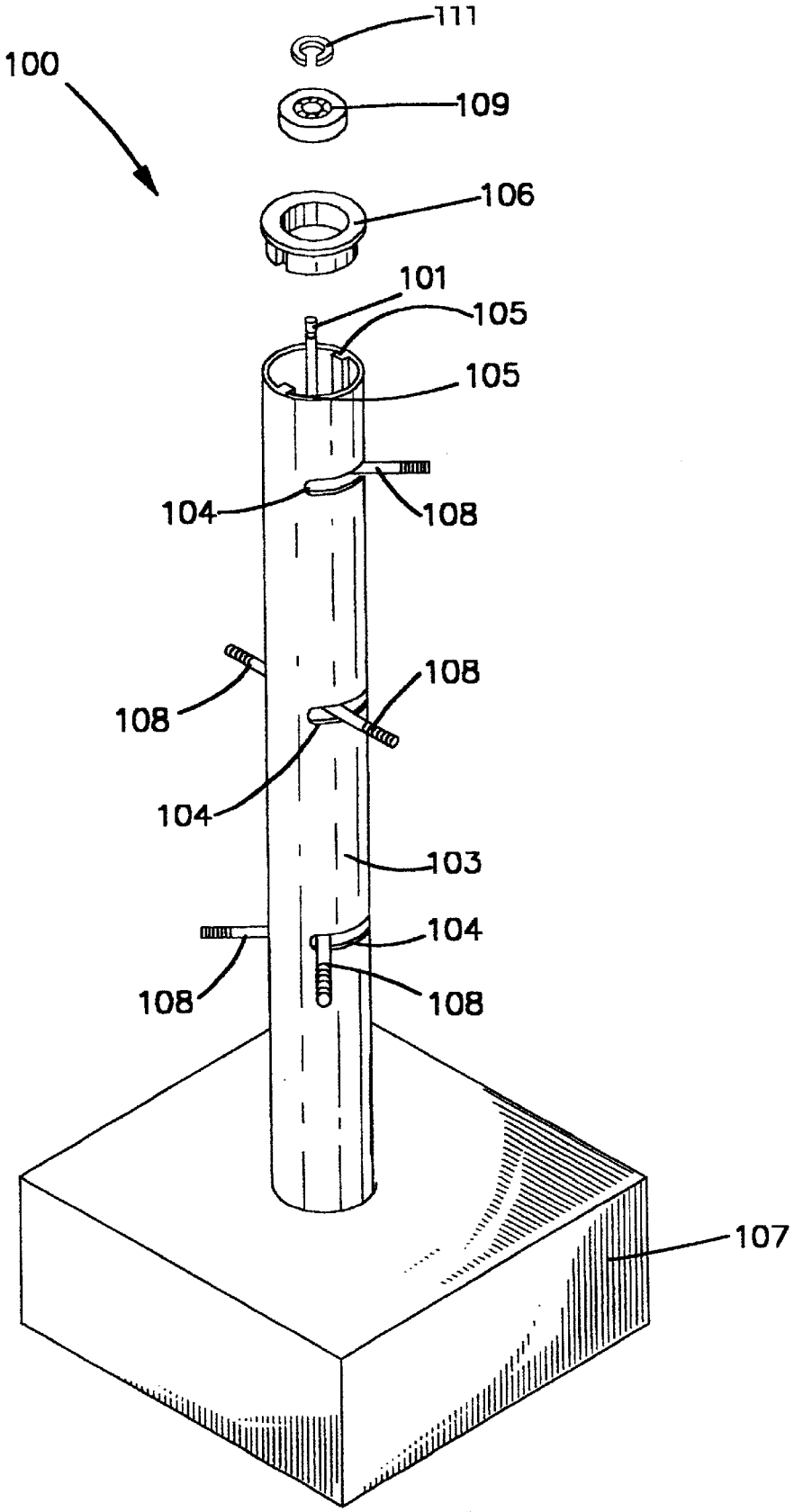
FIG. 5 is an exploded perspective view of a preferred embodiment of the invention showing details of central shaft assembly construction.

In FIG. 5 the upper components of central shaft assembly have been exploded to reveal additional details of the invention 1. Support tube 103 is ideally constructed of extruded aluminum and is provided with two longitudinal inner rails 105 which serve to guide the axial movement of the two inner cam slide members 112 (see FIG. 6), as well as prevent relative rotation between cam member 123 (composed of slide members 112) and support tube 103. End cap 106 is provided with a cup-shaped indentation which accepts and holds upper guide bearing 109 which, in turn, is affixed to central shaft 101 by a retaining clip 111. Upper guide bearing 109 provides stability to central shaft 101.

Figure 6:
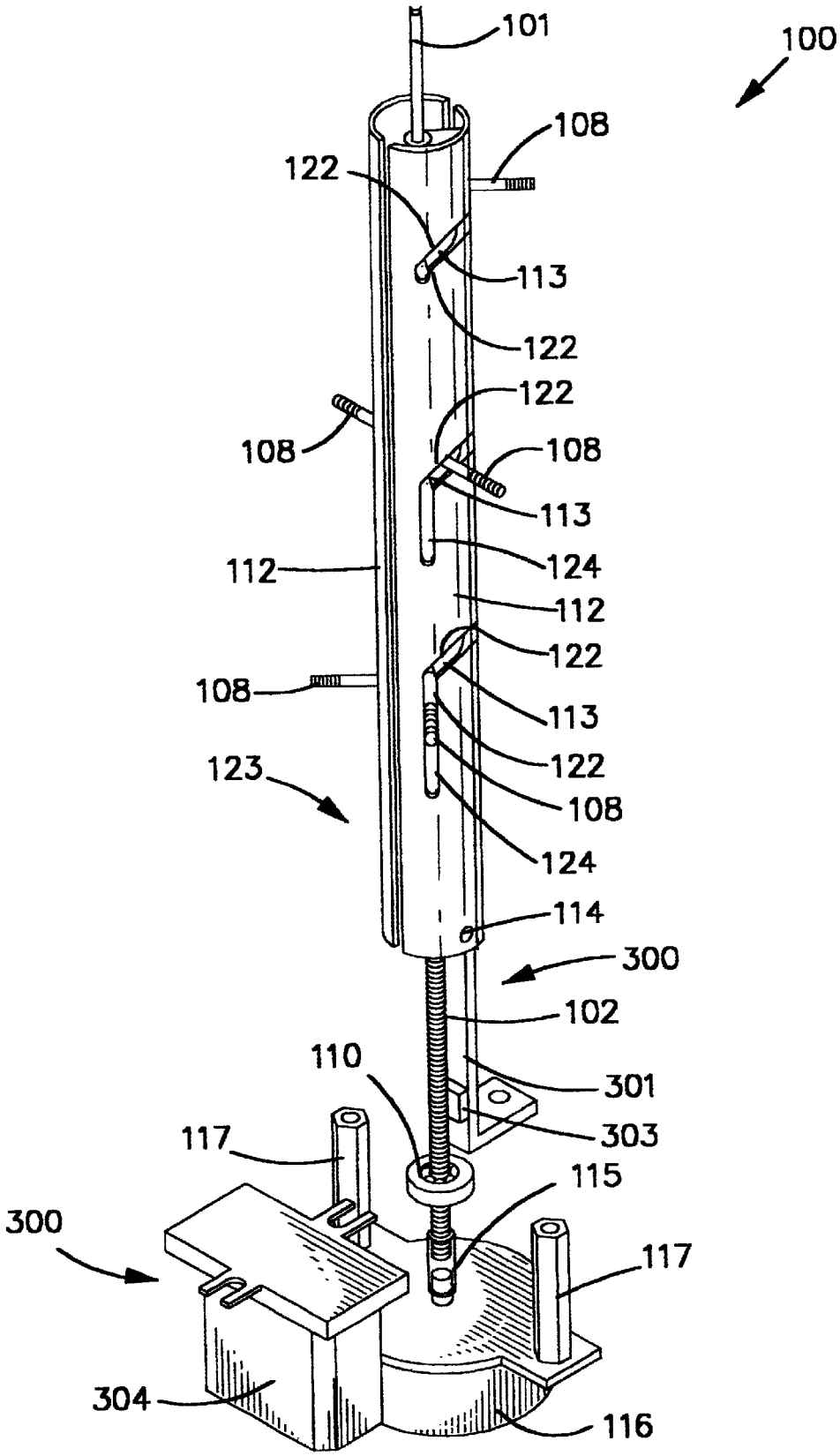
FIG. 6 is a perspective view of a preferred embodiment of the invention showing details of central shaft assembly construction with selected parts removed for clarity.

In FIG. 6 the support tube 103 and enclosure 107 have been removed to reveal additional details of central shaft assembly 100. Cam member 123 preferably comprises a pair of cam slide members 112, and is preferably tubular in cross-section. Various shapes of cam members 123 may be employed, although the tubular cam member 123 shown is extremely versatile. Cam slide members 112 are provided with a number of cam surfaces 122, which are positioned so as to be engageable with at least one support arm 108. Cam slide members 112 are axially movable in relation to central shaft 101. Preferably, cam surfaces 122 are included in cam slots 113, through which support arms 108 extend. In the embodiment shown, each of the two cam slide members 112 is provided with three cam slots 113. As cam slide members 112 move axially of central shaft 101, cam surfaces 122 come into contact with support arms 108, causing them to move circumferentially about central shaft 101. Lower shaft support bearing 110, latching relay 304 and limit switch bracket 301 attach directly to the underside of enclosure 107 (not shown), while a rotative force generator, such as an electric motor 116, is attached to the underside of enclosure 107 by means of mounting posts 117.

Figure 7:
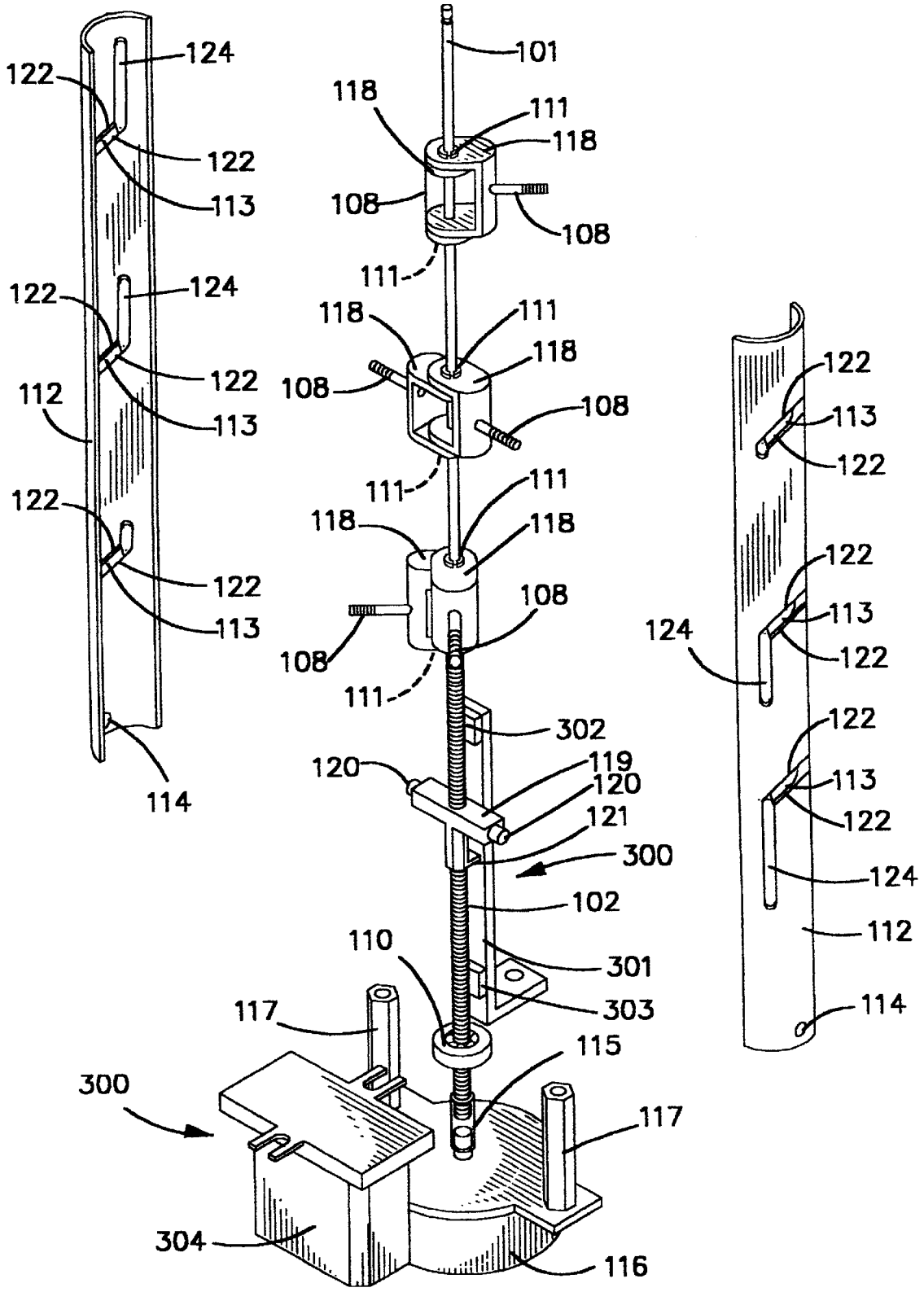
FIG. 7 is an exploded perspective view of a preferred embodiment of the invention showing the cam surfaces and inner shaft assembly components.

In FIG. 7 the two cam slide members 112 have been exploded to reveal further details of shaft assembly 101. Support arms 108 are rotatably attached to central shaft 101 using pivot blocks 118, which allow support arms 108 to rotate around central shaft 101. In the embodiment shown, pivot blocks are preferably rotatably attached to central shaft 101 in an axially fixed position using retaining clips 111. The lower end of central shaft 101 is connected to reversible motor 116 (such as a Hansen Model SC-234 motor) by a flexible coupling 115 and is provided with a threaded portion 102, preferably threaded with Acme threads. Threaded onto threaded portion 102 is yoke 119, which is movable axially along central shaft 101 by the action of motor 116 turning central shaft 101. This axial motion is transmitted to cam slide members 112 by coupling pins 120 on yoke 119, which engage yoke attachment holes 114. Yoke tongue 121 activates limit switches 302,303 (such as Micro Switch Model 1SX48-T switches) at either end of the yoke's limits of travel on threaded portion 102. Limit switches are positioned on limit switch bracket 301, and are electronically connected to latching relay 304 (such as a Potter & Brumfield Model KUL5A15S relay), which causes motor 116 to reverse rotation when a limit switch 302,303 is activated. In the embodiment shown, rotation of central shaft 101 is converted to axial force for moving cam member 123. However, alternate means, including external force, may be employed to axially move cam member 123.

Thus, yoke 119 and cam member 123 move back and forth axially along central shaft 101 as motor 116 operates. By changing the configuration of cam slots 113, one can change the sequences of visual element movement. In the embodiment shown, the axially-oriented portions 124 of cam slots 113 represent static periods during the choreography of movement of a particular support arm 108. Thus, as cam member 123 moves upward (away from motor 116) from the position shown in FIG. 1 to the position shown in FIG. 3, the upper level visual elements 201,202 move immediately, while middle level visual elements 203,204 move after a short delay, and lower level visual elements 205,206 move after a longer delay.

Figure 8:
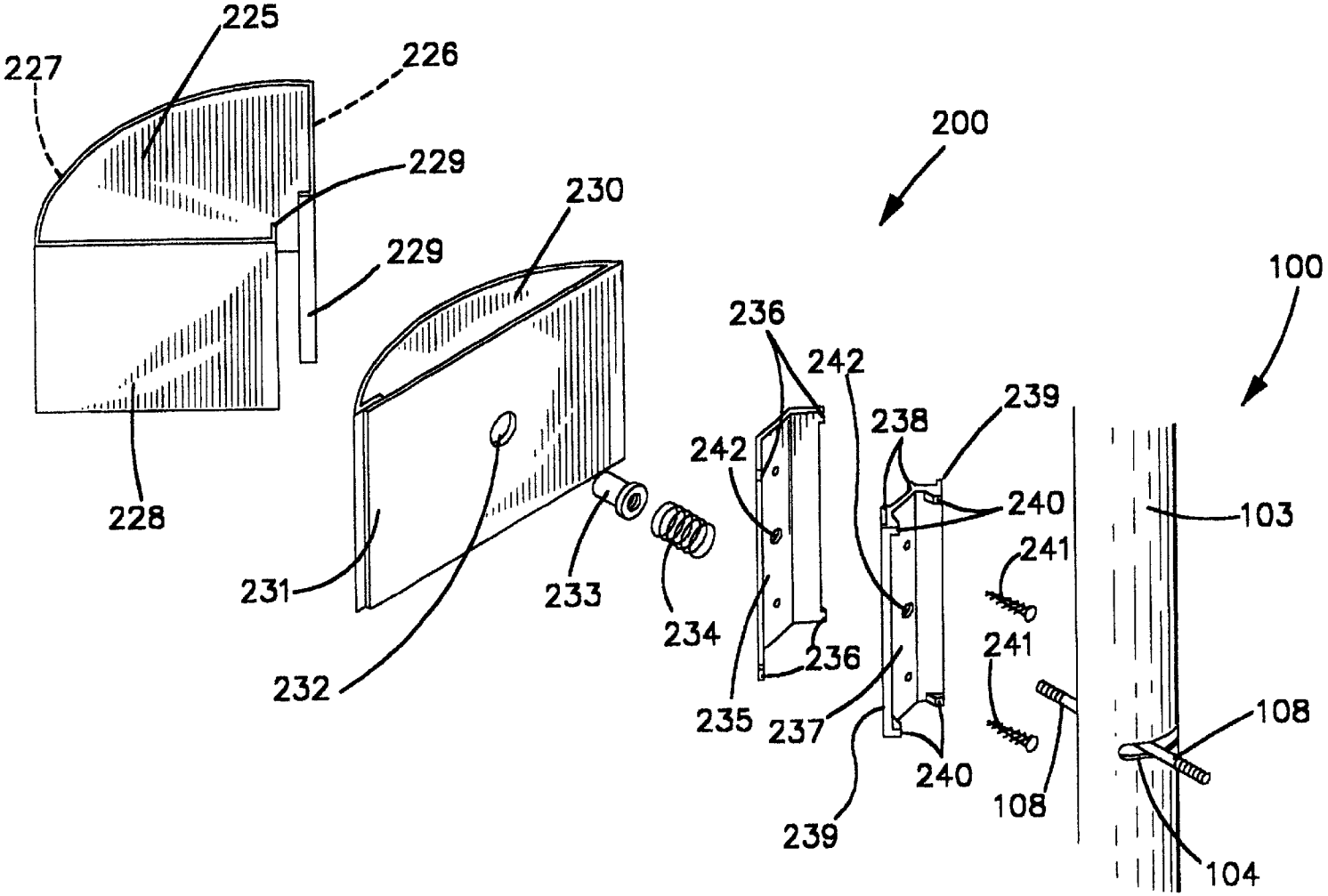
FIG. 8 is an exploded perspective view of a preferred embodiment of a visual element.

FIG. 8 is an exploded view of a preferred embodiment of a visual element 200, illustrated in relation to that section of central shaft assembly 100 to which it is attached via support arm 108. Visual element spine 237 and clamp 235 are held together by clamp screws 241, forming channels which entrap ears 229 of graphic sidewall 225. The correct width of these channels is established by spacer rails 238. Graphic alignment guides 236 and graphic retention ribs 239 help hold graphic sidewall 225 in the correct position. The shape of graphic sidewall 225 is maintained by form 230, which is held in shape by the tension in its inner chord. Form 230 is bonded together at tab 231. Both graphic sidewall 225 and form 230 are preferably constructed of printable, foldable sheet material such as styrene plastic. Support arm 108 extends through holes 242 in spine 237 and clamp 235, further penetrating spring 234, and terminating in a threaded connection to support arm end fitting 233. The compression of spring 234 forces the entire assembly into an axially aligned position on support tube 103. Slides 240 on spine 237 provide points of sliding contact with support tube 103. Slides 240, and preferably the entire spine 237, are constructed of self-lubricating plastic. Support arm end fitting 233 further engages form 230 via socket 232, by means of which engagement the circumferential motion of support arm 108 is imparted to form 230 and graphic sidewall 225. Graphic sidewall 225 displays on its outer surface graphic faces 226–228.

The shapes and configurations of the invention 1 are limitless. Other embodiments of the invention will occur to those of skill in the art, and are intended to be within the scope and spirit of the following claims.

I claim:

1. A display device, comprising:

a central shaft;

at least one support arm, rotatably attached to said central shaft; and a cam member having at least one cam surface, said cam surface positioned so as to be engageable with at least one said support arm, said cam member being movable at least axially in relation to said central shaft.

2. A display device according to claim 1, wherein said cam member is provided with at least one cam slot, and at least one said support arm extends through said cam slot.

3. A display device according to claim 1, wherein said support arm is axially fixed in position on said central shaft.

4. A display device according to claim 3, wherein said central shaft is provided with at least a threaded portion to which said cam member is threadably attached such that, as said central shaft is rotated, said cam member moves axially in relation to said shaft; and wherein said cam member is fixed in a non-rotatable position relative to said central shaft.

5. A display device according to claim 4, further comprising a rotative force generator, operably connected to said central shaft.

6. A display device according to claim 1, further comprising:

a support member, positioned in a spaced and fixed relationship with said central shaft and having at least one support arm slot positioned therein, with at least one said support arm extending through said support arm slot.

7. A display device according to claim 6, wherein said central shaft is provided with a threaded portion to which said cam member is threadably attached such that, as said central shaft is rotated, said cam member moves axially in relation to said shaft; and wherein said cam member is fixed in a non-rotatable position relative to said central shaft.

8. A display device according to claim 7, wherein said support arm slot is generally perpendicular to said central shaft.

9. A display device according to claim 6, wherein said support member is tubular.

10. A display device according to claim 6, wherein said cam member is tubular, said central shaft is positioned within said cam member, said support member is tubular, and said cam member is positioned within said support member.

11. A display device according to claim 10, wherein said central shaft is provided with a threaded portion to which said cam member is threadably attached such that, as said central shaft is rotated, said cam member moves axially in relation to said shaft; and wherein said cam member is fixed in a non-rotatable position relative to said central shaft.

12. A display device according to claim 11, wherein said cam member is provided with at least one cam slot, and at least one said support arm extends through said cam slot.

13. A display device according to claim 12, further comprising a rotative force generator, operably connected to said central shaft.

14. A display device according to claim 13, wherein said rotative force generator comprises a reversible motor.

15. A display device according to claim 14, further comprising a control assembly, which detects the axial position of said cam member and reverses the rotation of said motor and said central shaft when said cam member reaches a desired axial position, said control assembly being operably connected to said motor.

16. A display device according to claim 12, further comprising at least one visual element attached to said support arm.

17. A display device to claim 10, wherein said cam member is provided with at least one cam slot, and at least one said support arm extends through said cam slot.

18. A display device according to claim 1, wherein said cam member is tubular, and said central shaft is positioned within said cam member.

19. A display device according to claim 18, wherein said cam member is provided with at least one cam slot, and at least one said support arm extends through said cam slot.

20. A display device according to claim 1, further comprising at least one visual element attached to said support arm.

* * * * *